United States Patent [19]

Müller

[11] Patent Number: 4,505,658

[45] Date of Patent: Mar. 19, 1985

[54] MECHANISM FOR CENTERING REINFORCING MESH

[75] Inventor: Werner Müller, Ettlingen, Fed. Rep. of Germany

[73] Assignee: Maschinenfabrik Ettlingen Friedrich Pfeiffer KG, Ettlingen, Fed. Rep. of Germany

[21] Appl. No.: 551,825

[22] Filed: Nov. 15, 1983

[30] Foreign Application Priority Data

Apr. 6, 1983 [DE] Fed. Rep. of Germany ..... 3312396

[51] Int. Cl.[3] ..... B28B 7/02; B28B 21/56

[52] U.S. Cl. ..... 425/117; 249/83; 249/117; 425/262

[58] Field of Search ..... 425/110, 117, 256, 262; 249/83, 93, 205, 117; 264/275, 277, 278

[56] References Cited

U.S. PATENT DOCUMENTS

| | | | |
|---|---|---|---|
| 3,074,112 | 1/1963 | Bobrow | 264/275 |
| 3,090,999 | 5/1963 | Karns | 264/275 |
| 3,262,175 | 7/1966 | Gourlie et al. | 425/115 |
| 3,461,516 | 8/1969 | Boucher | 425/115 |
| 3,551,967 | 1/1971 | Williams | 425/117 |
| 3,551,968 | 1/1971 | Fosse et al. | 425/117 |
| 4,102,973 | 7/1978 | Hanning | 264/278 |
| 4,151,246 | 4/1979 | Lester et al. | 264/278 |

FOREIGN PATENT DOCUMENTS

| | | |
|---|---|---|
| 2607692 | 2/1979 | Fed. Rep. of Germany . |
| 2756313 | 6/1979 | Fed. Rep. of Germany . |

*Primary Examiner*—Willard E. Hoag
*Attorney, Agent, or Firm*—Holman & Stern

[57] ABSTRACT

An apparatus is disclosed for centering a reinforcing mesh which is in a pipe or conduit form for manufacturing reinforced concrete pipe or conduit. In order to automatically center the reinforcing mesh in a simple and reliable fashion, a plurality of mesh centering units are provided which are distributed at spaced intervals around the perimeter of the form. Each of these units comprises at least one radially outwardly extending member which penetrates through a receiving slot into the form to a depth which is adjustable depending on the external diameter of the reinforcing mesh. When the concrete introduced into the form is compacted, the member can be retracted to an inactive position from the operating position, in which it biases against the centered mesh.

20 Claims, 1 Drawing Figure

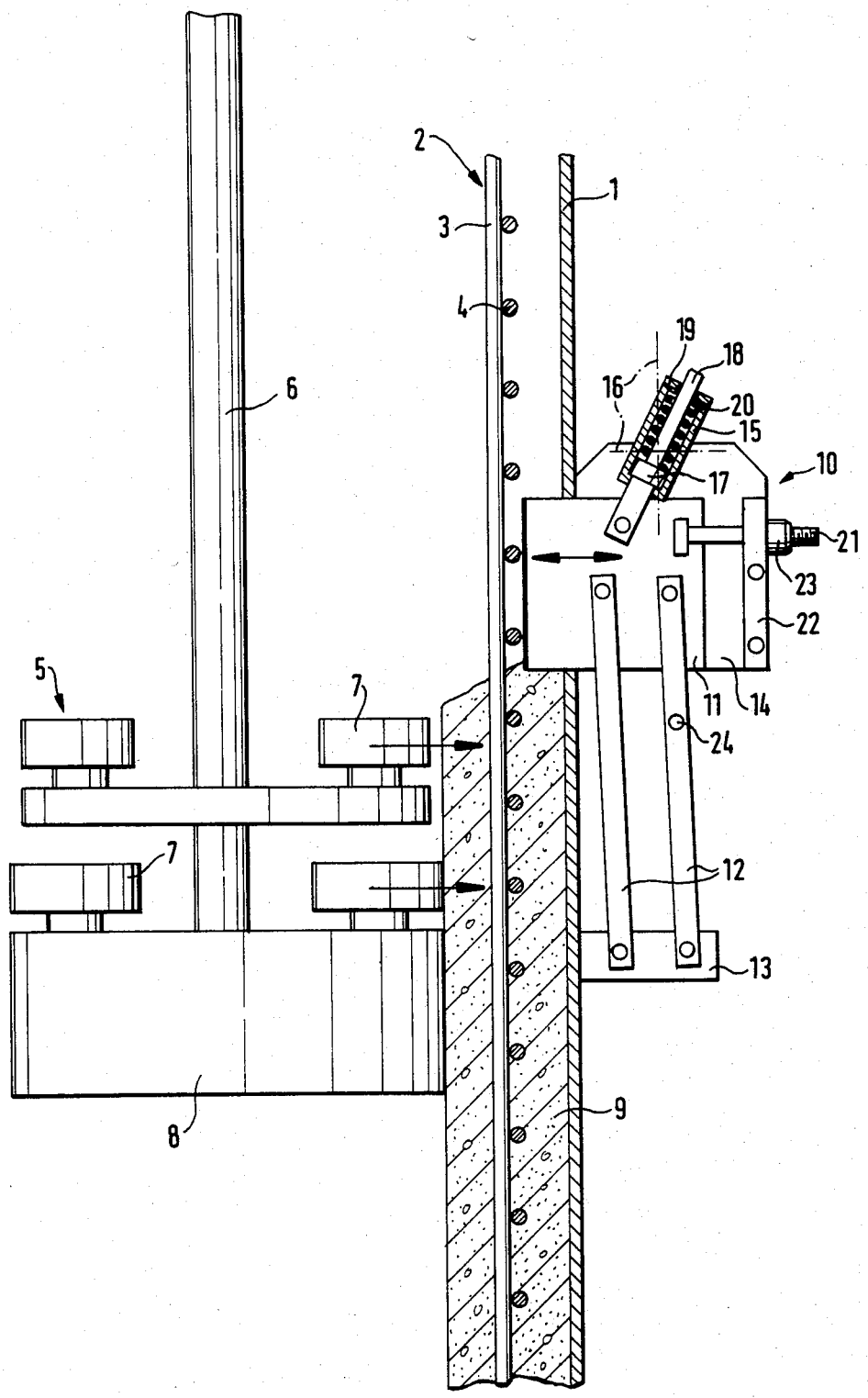
2
1
3
4
19
18
16
20
15
10
17
21
23
22
6
5
7
11
14
24
7
12
13
8
9

MECHANISM FOR CENTERING REINFORCING MESH

BACKGROUND OF THE INVENTION

1. Field of the Invention

This invention relates to a mechanism for centering a reinforcing mesh which is standing vertically in a conduit form for manufacturing concrete conduit.

2. Statement of the Prior Art

In the manufacture of mesh reinforced concrete pipe or conduit, whether with the aid of roller head machines for compacting or with the aid of vibration machines, it has been found to be costly as well as difficult and time consuming to properly center the reinforcing mesh in the forms and to ensure retention of the centering during the manufacturing process. In current practice it has been considered necessary to provoide costly steel or plastic spacers on the mesh. Apart from the cost, the spacers tend to cause leaks in the pipe or conduit because of displacement of the concrete.

The underlying problem of the invention is to devise a mechanism with whose aid the centered position of the reinforcing mesh can be maintained in a simple yet reliable fashion, both before and during the manufacture of mesh reinforced pipe or conduit.

SUMMARY OF THE INVENTION

The above problem is solved according to this invention by an apparatus which is distinguished by a plurality of centering units distributed at spaced intervals around the perimeter of the form. Each of these units comprises at least one radially outwardly extending member (centering piece) which may be acted on by a spring. The member penetrates into the form through a provided receiving slot to a depth which is adjustable depending on the external diameter of the reinforcing mesh. Moreover, the centering piece can be moved to a retracted inactive position (from the operating position, in which it biases against the centered mesh) under the action of the spring or other suitable biasing means when the concrete introduced into the form is compacted.

After the basic setting of the depth of penetration of the centering members into the form, which depth depends upon the difference in diameter between the form and the reinforcing mesh, the spring-loaded members of the centering units carry out the centering automatically. During the charging and compacting of the concrete the members keep the reinforcing mesh from moving out of control into an off-center position. During the compacting, each centering member (which is biasing against the reinforcing mesh) is subjected to radial force acting on its end face, as a result of which it moves away from the mesh (that is, against the action of the spring or other biasing means) and is returned to the retracted (inactive) position.

In order to be able to insert the reinforcing mesh into the form conveniently and without interference from the centering pieces, it has proven advantageous to employ an embodiment of the invention in which the centering member is spring loaded and guided, in relation to the form, in such a way that when said piece is moved from the biasing (operating) position into the retracted (inactive) position and back, in each such stroke it passes through a labile (metastable) deadpoint position.

From a manufacturing engineering standpoint it is very advantageous if the centering piece is in the form of a flat, preferably metal, disc or plate which extends through a corresponding narrow receiving slot running axially in the form and which slot closes when the centering member is in its retracted position.

BRIEF DESCRIPTION OF THE DRAWING

The sole FIGURE is a side partial cross-section of one embodiment of this invention, in which the form is standing vertically.

DESCRIPTION OF THE PREFERRED EMBODIMENTS

The FIGURE shows one side of a vertically standing pipe form or conduit form 1, and a reinforcing mesh 2 standing (vertically) in the form. The mesh may be comprised of reinforcing first wires 3 running parallel to the pipe or conduit axis, and second wires 4 which form a helix running up the form (i.e., from bottom to top in the FIGURE). The wires 3, 4 are welded together at their crossing points. The exact form of the mesh is not critical to this invention, provided that it affords an object against which the centering members may bias.

The roller head 5 of a roller head machine (not illustrated in detail) extends into the interior of the form 1. The roller head 5 is disposed at the lower end of a shaft 6 through which it is rotatable. It comprises a plurality of rollers 7 which accomplish the rolling-out (shaping) of the surface of the concrete, and a smooth piston 8. Concrete is charged to the form 1 from above and moves downward, and is compacted with the aid of the rotating roller head 5 to form the pipe or conduit 9. During the process the roller head 5 is moved upward (from bottom to top in the FIGURE) in the interior of the form 1. A plurality of, (typically three or four), centering units 10 are distributed at about equal distances around the perimeter of the form 1, the number of units 10 employed depending on the size of the form (and the pipe or conduit). Each centering unit 10 is comprised of at least one, preferably two, preferably parallel, centering members 11, preferably in the form of flat plates, each of which extends through a narrow receiving slot in the form 1. The slot is of corresponding cross-section (to the respective plates) and extends parallel to the axis of the form. In the drawing only the rearmost of the two centering members 11 is shown. Guide rods 12 are disposed between the two centering pieces and pivotably mounted thereon. The lower ends of said rods (the ends opposite to their upper pivot points on the centering members 11) are pivotably mounted to a lug 13 which is attached to the form 1. As seen from the drawing, the guide rods run parallel to each other and approximately parallel to the form axis. They enable the centering members 11 to move in a plane which is basically perpendicular to the form axis. Two plates (preferably metal) attached to the form so as to enclose between them the centering members 11 and parts of the guide rods 12 combine to form a housing 14. A cylindrical sleeve 15 is swingably mounted between the two plates of the housing. The swing axis of the sleeve runs perpendicular to the plane of the drawing. The mounting is accomplished with the aid of two radially extending pivot pins (not shown) which fit into accommodating holes in the housing. The swing axis of the sleeve 15 runs askew and parallel to a tangent to the form 1, at the location of the intersection of the two dot-dashed notional lines 16. A piston-like shouldered rod 17 is slidably housed interior to the sleeve 15. The external end of rod 17 which extends out between the two centering pieces 11 is pivotably attached to said pieces. A guiding extension 18 of smaller diameter on the opposite end of rod 17 extends through a hole in an end plate 19 of the sleeve 15. This extension 18 also extends through a helical spring 20 mounted in the sleeve 15, which spring exerts a force on the rod 17 in the direction toward the centering members 11. In the operating position of the centering members 11 as shown, under the action of the radial component of the force of the spring 20 said members 11 hold the reinforcing mesh in the desired centered position. In order to be able to set the depth of penetration of the centering members 11 into the form 1, there is provided a threaded bolt 21 which is welded to the centering members to extend perpendicularly to the form central axis (so that its axis intersects the form axis), and which bolt passes through a hole in a stop piece 22 which is secured to the housing 14. A nut 23 is screwed onto bolt 21. The stop piece 22 acts on its opposite face to limit the displacement of the centering members 11 out of the form and into their retracted inactive position, in which position the plane of their end faces (which face toward the mesh) is aligned with the interior surface of the form. The position of the swing axis of sleeve 15 is chosen with respect to stop piece 22 such that when the centering members 11 are moved back and forth between their biasing position and their retracted position the spring 20 passes through a condition of maximum compression, hence the centering pieces pass through a labile deadpoint position in each stroke.

As shown, the external of the two guide rods 12 is provided with a hole 24. This to accommodate a cable means (not shown) which passes around the form 1 through said hole and through similar holes in the guide rods of the other centering units 11. This is for cases in which the form has a longitudinally extending openable gap (i.e., a gap via which it is opened up) with an associated master closure mechanism having rotatable or swingable actuating elements (as disclosed in German patent specification No. 26 07 692). The cable may be connected to one of the actuating elements, so that when the openable gap is closed by means of the master closure mechanism the centering pieces are all moved from the inactive position into the operating position, as a result of the concurrent contraction of the cable.

At the start of the manufacture of a pipe or conduit the centering members 11 serve to effect trouble-free centering. During the manufacturing process the concrete which is compacted by the roller head 5 in the region of the lower end of the pipe 9 takes over the function of holding the reinforcing mesh in a centered position. As soon as the roller head 5 reaches the height in the vertical form 1 at which the centering units 10 are disposed, the centering members 11 move away under the pressure of the concrete acting on their end faces and against the resisting force of the return spring 20. They pass through the deadpoint and into the inactive position determined by the stop piece 22. This mode of operation may also be employed with pipe forming and conduit forming machines which do not have a roller head which exerts a radial compressive force. In vibratory compacting machines during compacting, concrete flows back into the region of the end faces of the centering pieces, is compacted, and, as in the case of roller head compacting, causes a gradual retraction of the centering members.

The spring force of the return spring may be readily increased by, e.g., inserting spacing washers (not shown) between the spring 20 and the end plate 19 on the cylindrical sleeve 15. Alternatively, the end plate 19 could be configured so that it could be screwed inward into the sleeve 15.

Although only one mesh centering unit and slot is shown in the Figure, the units and corresponding slots may be arranged at various points on the form. For example, 2 to 4, preferably 3 or 4, units and slots may be spaced equidistantly around a circumference of the form defined by a notional plane perpendicular to the form's central axis, to form a "set". Several sets may be employed, spaced from each other along the length of the central axis, depending upon the length of the reinforced concrete pipe or conduit being formed.

This invention is not limited to the use of a particular shape of form, which form may be a polygon such as a square or hexagon, or may be round, oval, ovoid, and the like, all in cross-section perpendicular to its central axis.

I claim:

1. An apparatus for centering a reinforcing mesh standing in a pipe form for the manufacture of reinforced concrete pipe or conduit comprising:

a plurality of centering units distributed at equal spaced intervals around a perimeter of a form for making concrete pipe, each said unit comprising at least one centering member projecting into said form radially from the outside, the depth of penetration of said member into said form being adjustable as a function of outer diameter of said reinforcing mesh, said member being adapted to be taken into a retracted position of rest from its working position during which it bears against said reinforcing mesh as the concrete introduced in said form is being compacted, wherein each centering member of said centering units has associated with it a spring for supporting and actuating said member in a manner such as to pass an unstable dead-center position each time it is taken from its working position into its position of rest, or from its position of rest to a working position.

2. The apparatus of claim 1 wherein the adjustable means further comprises a threaded bolt extending perpendicularly to the central axis of the form, so that its axis intersects the form axis, and which has a nut screwed onto it, so that the depth of penetration of the member through the receiving slot into the form may be set by means of said bolt and nut.

3. The apparatus of claim 1 further comprising a form further having a longitudinally extending openable gap and a master closure mechanism having rotatable or swingable actuating elements, and wherein each of the mesh centering units are operatively coupled to at least one of the actuating elements of the master closure mechanism via a connecting cable which passes around the form, so that when the openable gap is closed the members of the mesh centering units are biased inward and when the openable gap is opened said members are retracted.

4. The apparatus of claim 1 wherein said variable means for biasing and retracting the member comprises a spring operably connected to said member so that said member passes through a metastable deadpoint between its biasing mode and its retracted mode.

5. The apparatus of claim 4 wherein each said member comprises a flat plate and wherein said receiving slot is narrow and complementarily shaped to receive said plate, the narrow portion thereof running parallel to the central axis of the form.

6. The apparatus of claim 5 wherein a support lug is mounted on the outside of the form near each receiving slot and two parallel guide rods are pivotably mounted to said lug at one end and to said member at the other end, said guide rods being generally parallel to the central axis of the form.

7. The apparatus of claim 1 wherein each said member comprises a flat plate and wherein said receiving slot is narrow and complementarily shaped to receive said plate, the narrow portion thereof running parallel to the central axis of the form.

8. The apparatus of claim 7 wherein a support lug is mounted on the outside of the form near each receiving slot and two parallel guide rods are pivotably mounted to said lug at one end and to said member at the other end, said guide rods being generally parallel to the central axis of the form.

9. The apparatus of claim 8 wherein said mesh centering unit has two members and said guide rods extend between said members and wherein a housing comprising two pieces which encompass between them said members and at least part of said rods is mounted on the outside of the form.

10. The apparatus of claim 8 wherein a housing for said member is mounted on the outside of the form and comprises a stop piece which determines the maximum retracted position of said member.

11. The apparatus of claim 7 wherein said variable means further comprises a shouldered rod which is pivotably connected to said at least one member through an axis which is askew and perpendicular to the central axis of the form, a helical spring surrounding said rod and stopped at one end by said shoulder, and a cylindrical sleeve surrounding said rod and helical spring, so that said spring acts upon said at least one member through said rod.

12. The apparatus of claim 10 wherein the adjustable means further comprises a threaded bolt extending perpendicularly to the central axis of the form, so that its axis intersects the form axis, and which has a nut screwed onto it, so that the depth of penetration of the member through the receiving slot into the form may be set by means of said bolt and nut.

13. The apparatus of claim 12 wherein the threaded bolt extends through a hole in the stop piece of the housing.

14. The apparatus of claim 13 wherein said variable means further comprises a shouldered rod which is pivotably connected to said at least one member through an axis which is askew and perpendicular to the central axis of the form, a helical spring surrounding said rod and stopped at one end by said shoulder, and a cylindrical sleeve surrounding said rod and helical spring, so that said spring acts upon said at least one member through said rod.

15. The apparatus of claim 14 wherein said helical spring is adjustable as to its force.

16. The apparatus of claim 15 wherein said mesh centering unit has two members and said guide rods extend between said members and wherein a housing comprising two pieces which encompass between them said members and at least part of said rods is mounted on the outside of the form.

17. The apparatus of claim 16 wherein said cylindrical sleeve is swingably mounted through holes in the pieces comprising the housing, said mounting being by means of pivot pins which extend radially from the cylindrical sleeve, and wherein the shouldered rod is swingably mounted between the two extending members, so that both said members may be simultaneously biased or retracted.

18. The apparatus of claim 17 further comprising a form further having a longitudinally extending openable gap and a master closure mechanism having rotatable or swingable actuating elements, and wherein each of the mesh centering units are operatively coupled to at least one of the actuating elements of the master closure mechanism via a connecting cable which passes around the form, so that when the openable gap is closed the members of the mesh centering units are biased inward and when the openable gap is opened said members are retracted.

19. The apparatus of claim 18 wherein said connecting cable operates by contraction concurrent with the closing of the gap and operatively engages one of the parallel connecting guide rods of each mesh centering unit.

20. The apparatus of claim 19 wherein a hole is provided in said connected guide rod through which said connecting cable passes.

* * * * *